US005729839A

United States Patent [19]

Bigelow

[11] Patent Number: 5,729,839

[45] Date of Patent: Mar. 24, 1998

[54] TOILET SEAT AND COVER HANDLE

[76] Inventor: Roderick F. Bigelow, 2659 Frembes, Waterford, Mich. 48329

[21] Appl. No.: 722,998

[22] Filed: Sep. 30, 1996

[51] Int. Cl.[6] ..... A47K 13/10

[52] U.S. Cl. ..... 4/246.1; 16/121

[58] Field of Search ..... 4/246.1, 246.3, 4/246.4; 16/114 R, 118, 121, 123, 124

[56] References Cited

U.S. PATENT DOCUMENTS

| | | | |
|---|---|---|---|
| 2,236,576 | 4/1941 | Loebner | 4/246.1 |
| 4,129,907 | 12/1978 | Vaughan et al. | 4/246.1 |
| 4,742,582 | 5/1988 | Giallourakis | 4/251 |
| 5,027,472 | 7/1991 | Goodman | 16/114 R |
| 5,058,215 | 10/1991 | Sims | 4/251 |
| 5,220,693 | 6/1993 | Paglia | 4/246.1 |
| 5,459,889 | 10/1995 | Jamison | 4/661 |

*Primary Examiner*—David J. Walczak

*Attorney, Agent, or Firm*—Joseph H. McGlynn; Patent & Trademark Services, Inc.

[57] ABSTRACT

An improved apparatus for raising and lowering toilet seats and covers which comprises a pair of handle assemblies which extend radially from the toilet seat and cover. Each handle assembly comprises a U-shaped bracket which is attached to the underside of the toilet seat or cover by screws or other suitable means. At the end of each bracket is a rod member having an interior threaded portion. A spherical handle member, having a cylindrical opening projecting therethrough, is rotatably mounted on the rod member and held in place by a screw threaded into the rod member.

2 Claims, 1 Drawing Sheet

FIG. 1
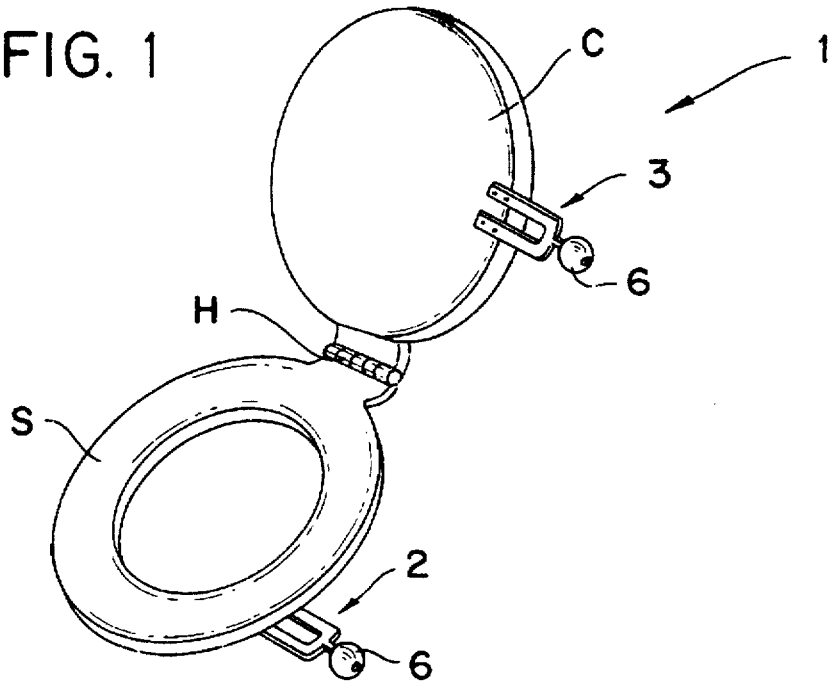
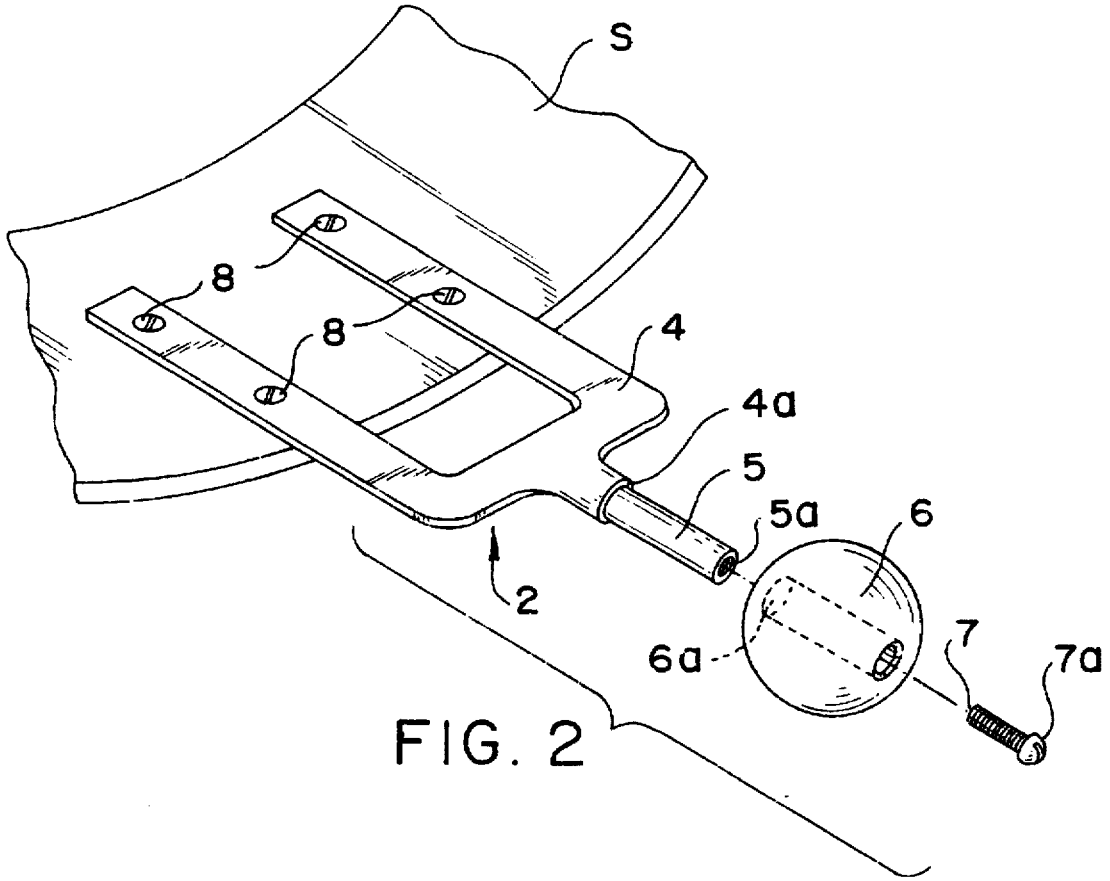
FIG. 2

TOILET SEAT AND COVER HANDLE

BACKGROUND OF THE INVENTION

The present invention relates generally to bathroom accessories, and in particular to a handle arrangement for lifting a toilet seat and cover without the need to touch the same.

DESCRIPTION OF THE PRIOR ART

There are known various handle arrangements which provide means to lift a toilet seat without the need to touch the seat with one's hand. These devices represent an attempt to render toilets, especially public ones, more sanitary and pleasant to use. As described below, however, these inventions suffer from a variety of drawbacks which make it desirable to have an improved toilet handle arrangement.

U.S. Pat. No. 4,742,582 describes a sanitary seat handle having one planar portion for the attachment to the underside of a toilet seat, and another planar portion extending radially outward therefrom. This invention is attached to a toilet seat by an adhesive means, which can become moistened, thereby causing the handle to become detached. Moreover, this handle is planar and difficult to grasp, requiring the user to place his or her hands in close proximity to the toilet seat.

U.S. Pat. No. 5,027,472 discloses a toilet seat handle comprising clamps spanned by a bolt. The clamps may be tightened to grasp the outer margins of a toilet seat. This invention provides a means to lift a toilet seat, but it cannot be used to lift a planar toilet seat cover.

U.S. Pat. No. 5,058,215 describes a toilet seat lifter which engages with the spacer bumper commonly found on the bottom of toilet seats. This invention, as well, is ineffectual for lifting a toilet seat cover. It is also undesirable because it is likely to become loosened and fall off of the toilet seat.

U.S. Pat. No. 5,459,889 discloses a handle apparatus for raising and lowering a toilet seat, having a handle which pivots between an extended and a retracted position. This invention is unsatisfactory, because in the retracted position it is difficult to grasp and unsanitary.

There remains a need in the art for a toilet handle apparatus which enables the user to lift both the toilet seat and the seat cover without having to touch either. Moreover, there remains a need for a toilet handle that is easy to grasp, and one which will stay securely attached. The present invention, described in detail below, overcomes the disadvantages of the prior art toilet seat handle arrangements, and also affords advantages not provided by the toilet seat handle arrangements heretofore disclosed.

SUMMARY OF THE INVENTION

The present invention is an improved handle arrangement for toilet seats and covers. The invention comprises a pair of "U" shaped, planar bracket members which are connected to the underside of a toilet seat and of a seat cover. Each bracket member has a rod connected at one end, said rods extending radially from the toilet bowl. The rods are hollow, cylindrical members having a threaded interior capable of receiving screws. Spherical handle members having centrally located, cylindrical openings receive the rods, such that the spherical handle members are rotatable around an axis defined by the rod members. Screws are threaded into the interior portion of the rod members to hold the spherical handle members in place.

The handle arrangement of the present invention may be installed on any type of toilet seat and cover. It provides an easy-to-grasp, convenient, and sanitary arrangement for raising and lowering toilet seats and covers without the need to touch the same with the hands.

Accordingly, it is an object of the present invention to provide an improved toilet handle arrangement.

It is a further object of this invention to provide a toilet handle arrangement which is sanitary, convenient, and easy to install.

It is still further an object of this invention to provide a toilet handle arrangement which can be used to raise and lower both a toilet seat and the toilet seat cover.

These and other objects and advantages of the present invention will become fully apparent from the detailed description below, when taken in conjunction with the annexed drawings.

BRIEF DESCRIPTION OF THE DRAWINGS

FIG. 1 shows a perspective view of the handle arrangement of the present invention, installed on a toilet seat and cover apparatus.

FIG. 2 shows an enlarged, exploded view of a handle of the present invention, installed on the underside of the toilet seat.

DESCRIPTION OF THE PREFERRED EMBODIMENT

Referring now to the drawings in greater detail, shown in FIG. 1 is a conventional toilet seat S and cover C apparatus with the handle arrangement of the present invention 1 installed thereon. The seat S and cover C are hingedly connected at H, being movable between a down position, in which the seat S is depicted, and an up position, in which the cover C is depicted. As shown in FIG. 1, the present invention 1 comprises a pair of handle assemblies 2, 3 which extend radially from the toilet seat S and cover C, providing a means to raise and lower the seat S and cover C without a person having to touch either with his/her hands.

Shown in FIG. 2 is an enlarged, exploded view of one of the handle assemblies 2 of the present invention 1 attached to the underside of the toilet seat S. As shown in FIG. 2, the handle assembly 2 comprises a generally U-shaped attachment bracket 4, a rod member 5, and a spherical handle member 6. The attachment bracket 4 connects to the underside of the toilet seat S and extends some distance beyond the outer margin of the seat S. The attachment bracket 4 is preferably secured to the underside of the toilet seat S by screws 8, as shown in FIG. 2, though other secure modes of attachment may be used without departing from the scope of the invention.

The rod member 5 is connected to the bracket 4 at the end of the bracket that is furthest from the margin of the seat S. As shown in FIG. 2, a lip or ferrule **4*a* is formed at the point of connection between the bracket 4 and the rod member 5, with the lip or ferrule 4*a* being of slightly greater diameter than that of the rod member 5. As described in greater detail below, the lip 4*a* provides a stop to hold the spherical handle member 6 in place. The rod member 5 is hollow, having an interior threaded portion 5*a* capable of receiving a screw or bolt 7**.

The spherical handle member 6 is rotatably mounted on the rod member 5, in the fashion described below. As shown best by the shadow lines in FIG. 2, spherical handle member 6 has a cylindrical opening **6*a* projecting through the center thereof. The opening 6*a* is of slightly greater diameter than the rod member 5, such that the spherical handle member 6** may receive the rod member 5. The opening 6*a* is, however, of lesser diameter than the lip 4*a*, which provides a stop to maintain the spherical handle member 6 at a certain distance from the bracket 4. A screw 7, having a drive head 7*a* of greater width than the opening 6*a*, is threaded into the rod member 5, thereby holding the spherical handle member 6 rotatably on the rod member 5.

As shown in FIG. 1, the handle assembly 2 on the toilet seat S extends slightly further away from the hinge H than does the other handle assembly 3 attached to the toilet cover C. This difference is preferable to avoid contact between the spherical handle members 6, which could interfere with the closing of the cover C. This differential is also preferable to enable the user to grasp the spherical handles 6 more easily, and to enable the user to differentiate between the two assemblies 2, 3.

The rotatable spherical handle members 6 make it easy for small children and/or handicapped people to manipulate the seat and cover. Since the handle rotates, it will not be necessary for a person to turn their wrists awkwardly in order to lift the seat and/or cover as they move from a horizontal (closed) position to a vertical (open) position.

The present invention 1 may be constructed inexpensively from ABS plastic, using the injection molding process. Other materials, such as brass, aluminum, or stainless steel may also be used. The invention 1 may be quickly and easily installed on any toilet. In use, it provides a convenient, attractive, and sanitary means to raise and lower toilet seats and covers without having to touch the same with the hands.

Although the toilet handle arrangement and the method of using the same according to the present invention has been described in the foregoing specification with considerable details, it is to be understood that modifications may be made to the present invention which do not exceed the scope of the appended claims and modified forms of this invention done by others skilled in the art to which the invention pertains will be considered infringements of this invention when those modified forms fall within the claimed scope of the invention.

What I claim as my invention is:

1. A toilet seat and cover handle assembly comprising:

a toilet seat and toilet seat cover, means for lifting said seat without the need to touch said seat, means for lifting said seat cover without the need to touch said seat cover, means for securing said means for lifting said seat to said seat, means for securing said means for lifting said seat cover to said seat cover, and rotatable means secured to each of said lifting means whereby a user can lift said seat and cover from a horizontal to a vertical position conveniently, and wherein said means for lifting said seat is a U-shaped bracket attached to an underside of said seat, said bracket having a stop means attached to a portion of said bracket, a cylindrical portion attached adjacent said stop means, said cylindrical portion having an external diameter, said cylindrical portion being at least partially hollow and having internal screw threads, said rotatable means being a sphere with an aperture extending therethrough, said aperture having a diameter which is larger than said external diameter of said cylindrical portion, attachment means extending into said internal screw threads in said cylindrical portion for securing said rotatable means to said cylindrical portion.

2. A toilet seat and cover handle assembly comprising:

a toilet seat and toilet seat cover, means for lifting said seat without the need to touch said seat, means for lifting said seat cover without the need to touch said seat cover, means for securing said means for lifting said seat to said seat, means for securing said means for lifting said seat cover to said seat cover, and rotatable means secured to each of said lifting means whereby a user can lift said seat and cover from a horizontal to a vertical position conveniently, and wherein said means for lifting said seat cover is a U-shaped bracket attached to an underside of said seat cover, said bracket having a stop means attached to a portion of said bracket, a cylindrical portion attached adjacent said stop means, said cylindrical portion having an external diameter, said cylindrical portion being at least partially hollow and having internal screw threads, said rotatable means being a sphere with an aperture extending therethrough, said aperture having a diameter which is larger than said external diameter of said cylindrical portion, attachment means extending into said internal screw threads in said cylindrical portion for securing said rotatable means to said cylindrical portion.

* * * * *